US012673749B2

(12) United States Patent
Dubé

(10) Patent No.: US 12,673,749 B2
(45) Date of Patent: Jul. 7, 2026

(54) BOAT WINDSHIELD FRAME

(71) Applicant: PRELCO INC., Rivière-du-Loup (CA)

(72) Inventor: Simon Dubé, Rivière-du-Loup (CA)

(73) Assignee: Prelco Immo Inc., Rivière-du-Loup (CA)

( * ) Notice: Subject to any disclaimer, the term of this patent is extended or adjusted under 35 U.S.C. 154(b) by 342 days.

(21) Appl. No.: 18/604,937

(22) Filed: Mar. 14, 2024

(65) Prior Publication Data

US 2024/0308623 A1 Sep. 19, 2024

Related U.S. Application Data

(60) Provisional application No. 63/451,958, filed on Mar. 14, 2023.

(51) Int. Cl.
*B63B 17/02* (2006.01)

(52) U.S. Cl.
CPC ..... *B63B 17/02* (2013.01)

(58) Field of Classification Search
CPC . B63B 17/00; B63B 2017/0045; B63B 17/02; B63B 2017/026; B63B 19/00; B63B 2019/0007; B63B 2019/0038; B63B 2019/0046; B63B 19/02
USPC ..... 114/343, 361, 364
See application file for complete search history.

(56) References Cited

U.S. PATENT DOCUMENTS

| | | | | |
|---|---|---|---|---|
| 3,843,982 | A * | 10/1974 | Lane | B60J 1/06 156/107 |
| 5,664,519 | A * | 9/1997 | Erskine | B63B 19/02 114/361 |
| 6,647,914 | B1 * | 11/2003 | Gerhardinger | B63B 19/02 114/361 |
| 7,503,275 | B2 * | 3/2009 | Daniels | B63B 17/02 114/361 |
| 9,085,344 | B2 * | 7/2015 | Dube | B63B 19/02 |
| 12,486,008 | B2 * | 12/2025 | Oakes | B63B 73/46 |
| 2002/0184842 | A1 * | 12/2002 | Norman | B60J 1/02 52/204.53 |
| 2004/0238101 | A1 * | 12/2004 | Norman | B60J 1/02 156/108 |

* cited by examiner

*Primary Examiner* — Daniel V Venne
(74) *Attorney, Agent, or Firm* — Leber IP Law; Celia H. Leber

(57) ABSTRACT

A boat windshield frame system comprising a frame having opposed lips forming a gap in between. At least one intermediate holding portion comprises a pair of outward members to engage with the opposed lips in the gap of the frame for securing the at least one intermediate holding portion to the frame by clipping or by sliding. The at least one intermediate holding portion further comprising a pair of arms forming a grip to secure a decorative molding comprising an outer wall and an elongated member opposite the outer wall for connection to the at least one intermediate holding portion, the elongated member being shaped complementary to an inside of the grip of the intermediate holding portion. The decorative molding may be made of extruded aluminum and clipped onto the frame using the intermediate holding portion which can be provided as a plurality of interspaced segments.

20 Claims, 8 Drawing Sheets

BOAT WINDSHIELD FRAME

RELATED APPLICATION

The present patent application claims priority to, or benefit from, U.S. provisional Patent Application No. 63/451,958, filed Mar. 14, 2023, which is incorporated herein by reference in its entirety.

BACKGROUND

(a) Field

The subject matter disclosed generally relates to boat windshields. More specifically, it relates to a system for holding a decorative molding onto the frame of the boat windshield.

(b) Related Prior Art

There are boat windshields comprising a frame for holding the windshield in which there is provided, in addition to the frame, a decorative molding provided for aesthetic reasons. This can be embodied as an elongated metal band made of a stainless steel having a mirror finish, for example, and which is apparent at the surface of the windshield frame.

This is however costly to achieve, since an extruded stainless steel with a particular cross section shape needs to be produced, and then treated to apply the desired finish on the visible portion thereof. This is not only costly, but technically hard to perform, notably in view of the difficulty of extruding complex shapes when the material is stainless steel, practically limiting the resulting shape and increasing the manufacturing cost.

There is a need for a manufacturing process for boat windshield decorative molding which would make it easier and cheaper to manufacture.

SUMMARY

According to an aspect of the disclosure, there is described a boat windshield frame system comprising:

- a frame having opposed lips forming a gap in between;
- at least one intermediate holding portion comprising a pair of outward members configured to engage with the opposed lips in the gap of the frame for securing the at least one intermediate holding portion to the frame, the at least one intermediate holding portion further comprising a pair of arms forming a grip; and
- a decorative molding comprising an outer wall and an elongated member opposite the outer wall for connection to the at least one intermediate holding portion, the elongated member being shaped complementary to an inside of the grip of the at least one intermediate holding portion.

According to an embodiment of the disclosure, the at least one intermediate holding portion is made of a plastic material for clipping the pair of outward members thereof to the opposed lips of the frame.

According to an embodiment of the disclosure, the at least one intermediate holding portion is made of a plastic material and for clipping the elongated member of the decorative molding onto the pair of arms of the at least one intermediate holding portion.

According to an embodiment of the disclosure, the at least one intermediate holding portion comprises a plurality of intermediate holding portions clipped onto the frame in an interspaced manner, According to an embodiment of the disclosure, the decorative molding is clipped onto the plurality of intermediate holding portions clipped onto the frame in the interspaced manner.

According to an embodiment of the disclosure, the at least one intermediate holding portion has the pair of outward members slidingly inserted within the opposed lips of the frame in a rail arrangement.

According to an embodiment of the disclosure, the at least one intermediate holding portion comprises a plurality of intermediate holding portions slidingly inserted in the frame in an interspaced manner.

According to an embodiment of the disclosure, the decorative molding is clipped onto the plurality of intermediate holding portions clipped onto the frame in the interspaced manner.

According to an embodiment of the disclosure, the elongated member of the decorative molding is slidingly inserted within the pair of arms of the at least one intermediate holding portion in a rail arrangement.

According to an embodiment of the disclosure, the decorative molding is made of aluminum (but could be stainless steel, plastic) which is extruded to form the decorative molding.

According to an embodiment of the disclosure, the frame is made of aluminum which is extruded to form the frame.

According to an aspect of the disclosure, there is described a method for assembling boat windshield frame system comprising:

- providing a frame having opposed lips forming a gap in between;
- engaging at least one intermediate holding portion comprising a pair of outward members to the opposed lips in the gap of the frame for securing the at least one intermediate holding portion to the frame, the at least one intermediate holding portion further comprising a pair of arms forming a grip; and
- securing a decorative molding to the at least one intermediate holding portion, the decorative molding comprising an outer wall and an elongated member opposite the outer wall, the elongated member being shaped complementary to an inside of the grip of the at least one intermediate holding portion.

According to an embodiment of the disclosure, engaging the at least one intermediate holding portion to the opposed lips of the frame comprises clipping the pair of outward members thereof to the opposed lips of the frame.

According to an embodiment of the disclosure, securing the decorative molding to the at least one intermediate holding portion comprises clipping the elongated member of the decorative molding onto the pair of arms of the at least one intermediate holding portion.

According to an embodiment of the disclosure, the decorative molding is clipped onto the plurality of intermediate holding portions clipped onto the frame in the interspaced manner.

According to an embodiment of the disclosure, engaging the at least one intermediate holding portion to the opposed lips of the frame comprises slidingly inserting the pair of outward members within the opposed lips of the frame in a rail arrangement.

According to an embodiment of the disclosure, the at least one intermediate holding portion comprises a plurality of intermediate holding portions, wherein engaging the plurality of intermediate holding portions to the opposed lips of the frame comprises slidingly inserting the plurality of intermediate holding portions in the frame in an interspaced manner.

According to an embodiment of the disclosure, connecting the decorative molding to the at least one intermediate holding portion comprises clipping the decorative molding onto the plurality of intermediate holding portions clipped onto the frame in the interspaced manner.

According to an embodiment of the disclosure, securing the decorative molding to the at least one intermediate holding portion comprises slidingly inserting the decorative molding within the pair of arms of the at least one intermediate holding portion in a rail arrangement.

According to an aspect of the disclosure, there is described an intermediate holding portion for a boat windshield frame system comprising a frame having opposed lips forming a gap in between and a decorative molding, the intermediate holding portion comprising a pair of outward members configured to engage with the opposed lips in the gap of the frame for securing the at least one intermediate holding portion to the frame by clipping or by sliding, the at least one intermediate holding portion further comprising a pair of arms forming a grip to secure the decorative molding thereto by clipping or by sliding, the intermediate holding portion being of a material which is different from a material of the frame and different from a material of the decorative molding.

BRIEF DESCRIPTION OF THE DRAWINGS

Further features and advantages of the present disclosure will become apparent from the following detailed description, taken in combination with the appended drawings, in which.

DETAILED DESCRIPTION

As mentioned above with respect to the prior art, boat windshields may be fabricated with a decorative molding at the base of the frame holding the boat windshield. Providing this decorative molding made of stainless steel is costly and complicated, because the stainless steel may not be extruded with any arbitrary shape. In other words, it is easier to extrude aluminum with a complex shape than to extrude stainless steel with such a complex shape. However, stainless steel may offer a more valuable result in terms of aesthetics, especially if provided with a visually interesting finish such as a mirror finish or brushed finish, for example. All of this adds to the cost and manufacturing complexity.

Figure 1:
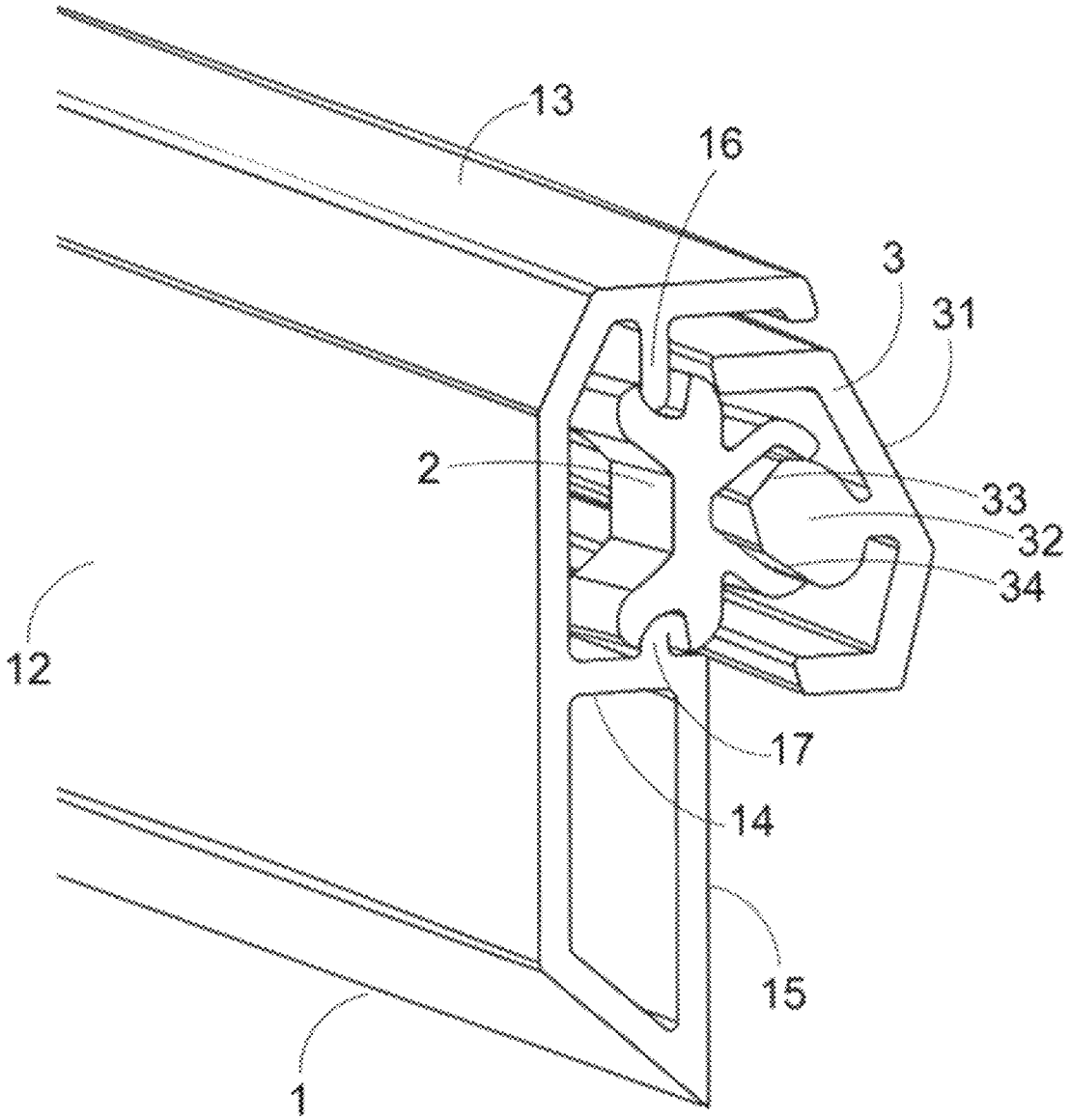
FIG. 1 is a perspective view illustrating a boat windshield frame system having a frame, an intermediate holding portion and a decorative molding assembled together, according to an embodiment of the invention.
Figure 2:
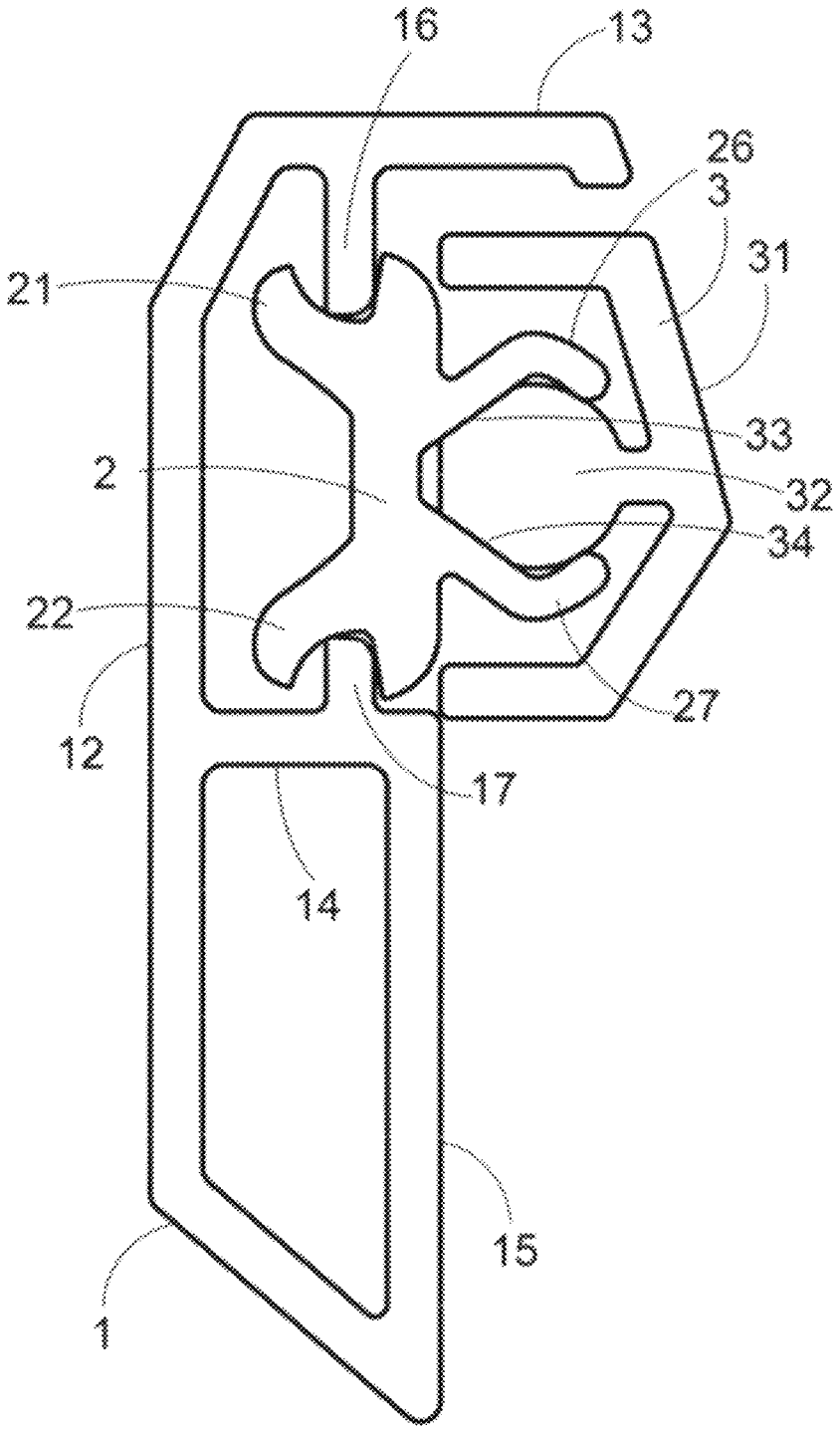
FIG. 2 is a side view or cross section illustrating a boat windshield frame system having a frame, an intermediate holding portion and a decorative molding assembled together, according to an embodiment of the invention.
Figure 3:
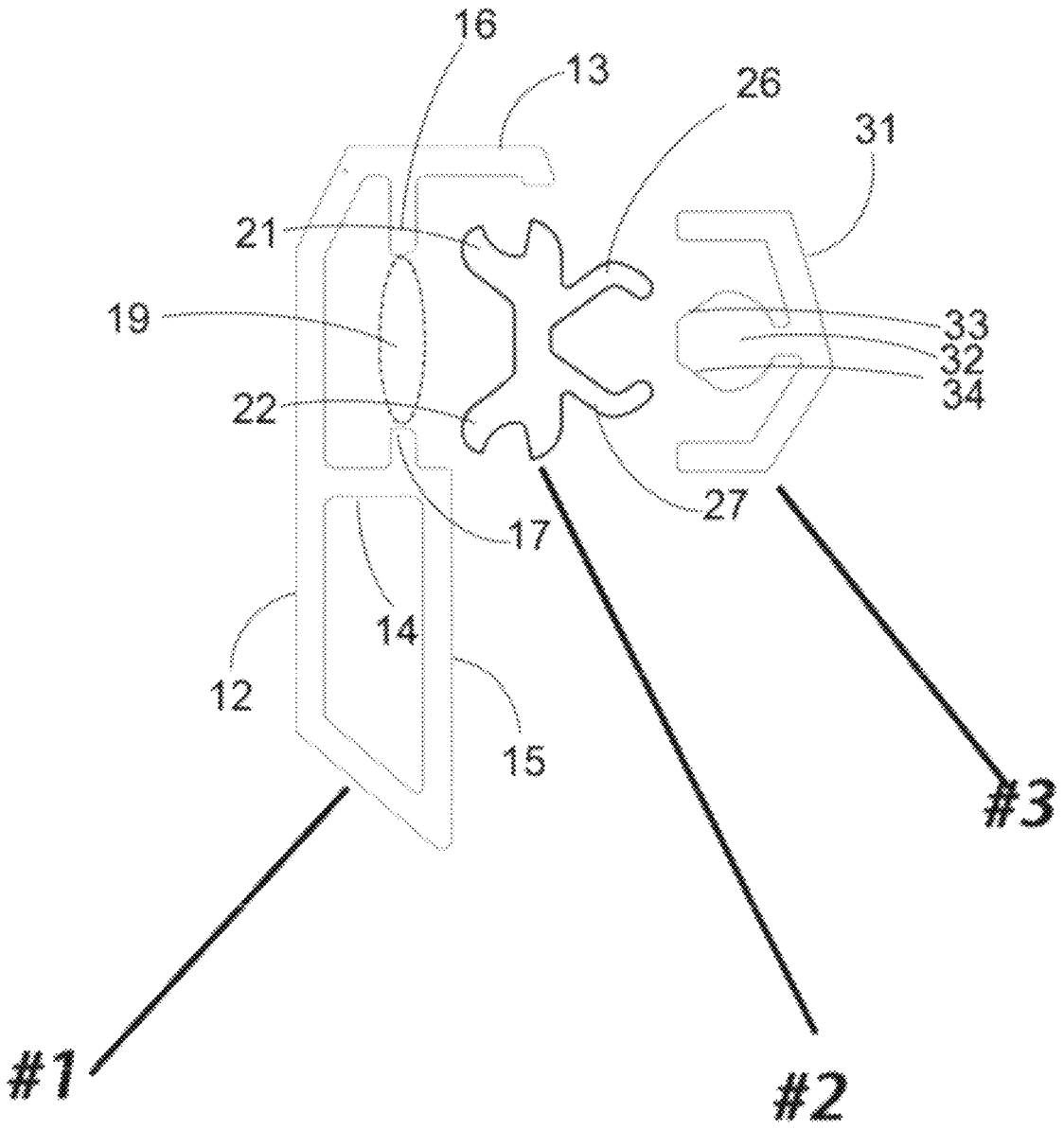
FIG. 3 is a side view or cross section illustrating a boat windshield frame system having a frame, an intermediate holding portion and a decorative molding (prior to assembly; or exploded view), according to an embodiment of the invention.

According to an embodiment of the disclosure, and as shown in FIGS. 1-3, there is described a support for a boat windshield comprising a frame 1, a decorative molding 3, and an intermediate holding portion 2 which is distinct and separate from the frame 1 and from the decorative molding 3 (i.e., it is not the same object, rather another piece of material). The intermediate holding portion 2 has a complex shape as it needs to be able to connect to the frame 1, on a first side, and to the decorative molding 3, on a second side (opposite the first side).

Figure 4:
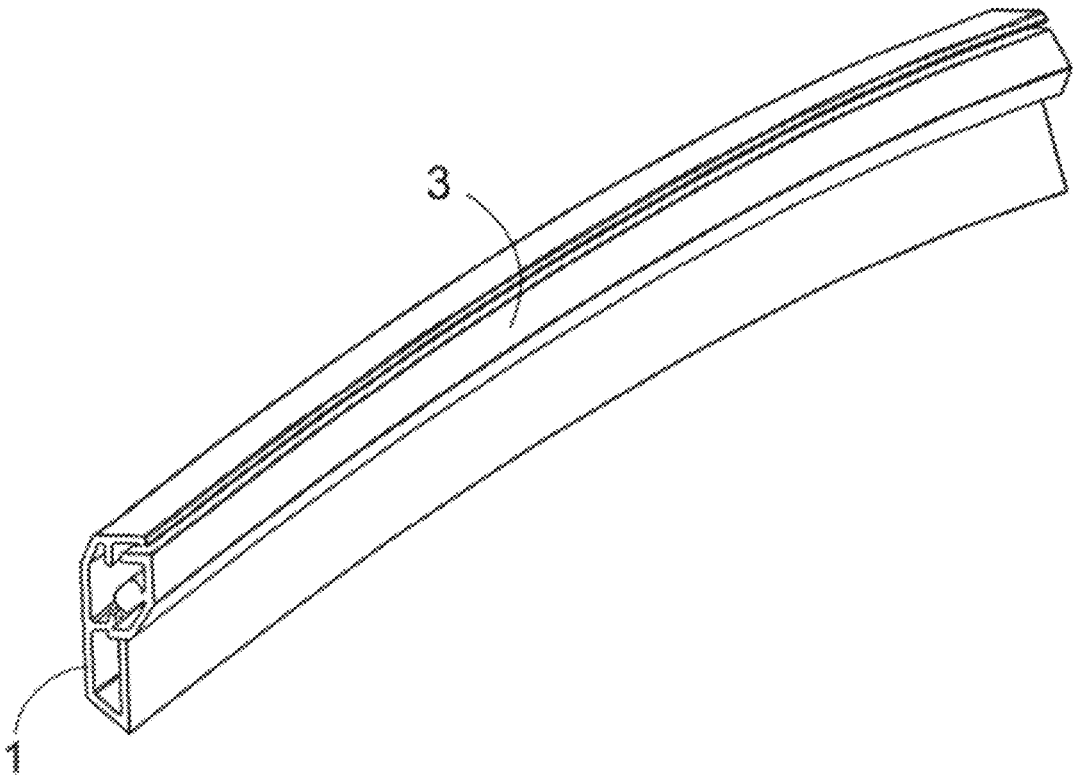
FIGS. 4 and 5 is a perspective view illustrating a boat windshield frame system having a frame, more than one intermediate holding portion and a decorative molding assembled together, with a spacing at the visible end, according to an embodiment of the invention.
Figure 5:
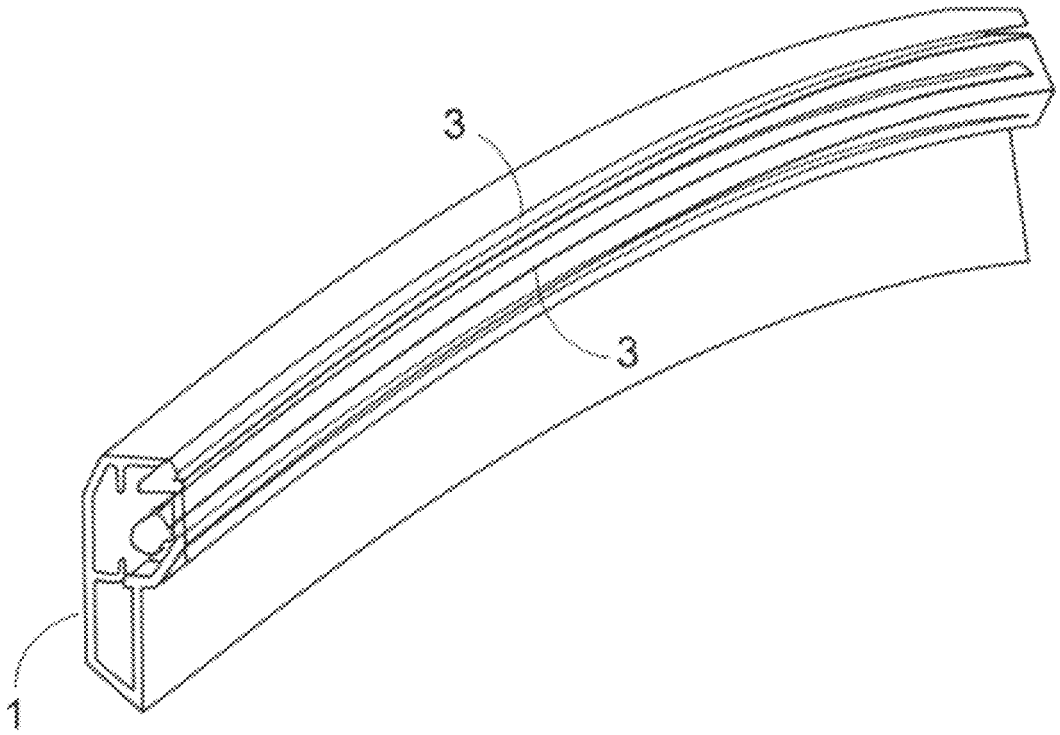
Figure 6:
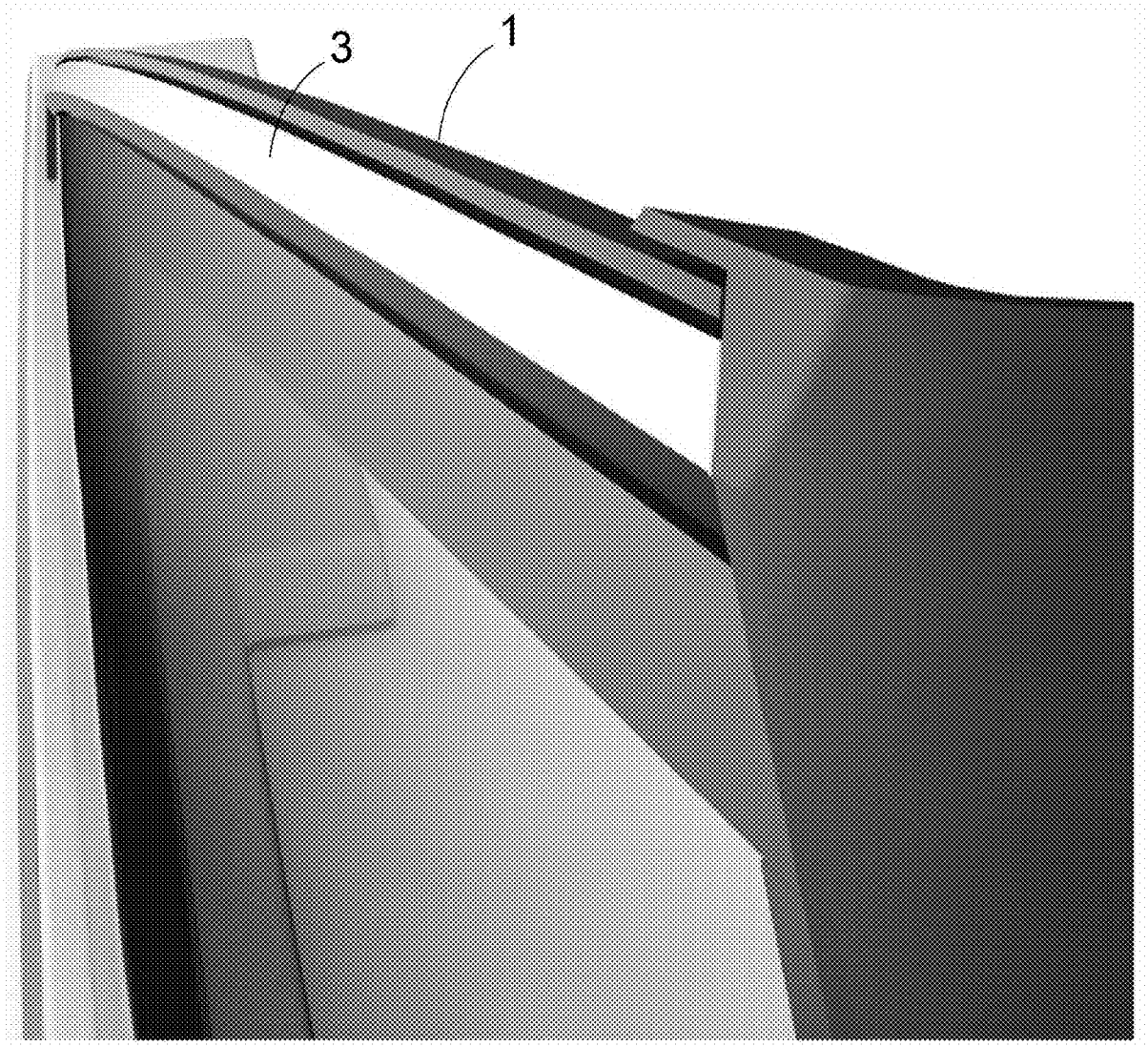
FIGS. 6 and 7 is a perspective view illustrating an assembled boat windshield frame system with a boat windshield, according to an embodiment of the invention.
Figure 7:
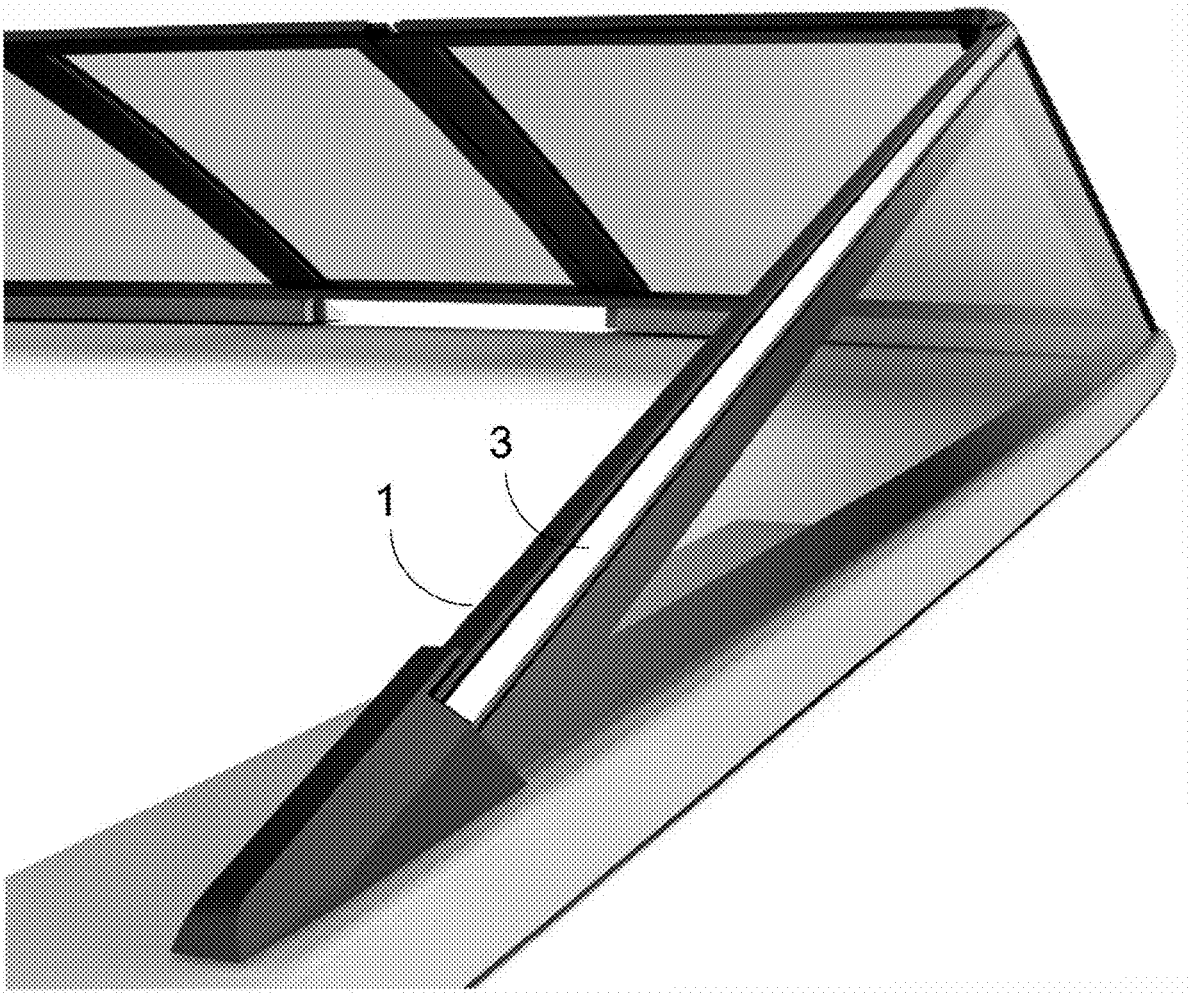

This system comprising the frame 1, the intermediate holding portion 2 and the decorative molding 3 is easier to manufacture because the decorative molding 3 may be made of a much simpler shape as the portion having a more complex shape which is for holding the decorative molding onto the frame is fabricated separately (that is the intermediate holding portion 2). Therefore, the decorative molding 3 may be made of any suitable material for such a purpose, including aluminum (or stainless steel, or plastic) which can be extruded (or could be molded or 3D-printed) the intermediate holding portion 2 may be made of any suitable material without any consideration for its aesthetic properties as this intermediate holding portion 2 is advantageously not visible from the outside. Indeed, it is hidden by the decorative molding 3 when the system is assembled on a boat, and it is sandwiched between the frame 1 and the decorative molding 3, as well shown in FIGS. 4-5, for example, illustrating the assembled system. The result on a boat with a windshield on the frame system according to the present disclosure is shown in FIG. 6-7.

Advantageously and without limitation, and according to an embodiment of the disclosure, the intermediate holding portion 2 is made of aluminum and is fabricated by extrusion, i.e., a part of aluminum is extruded into an elongated member having such a cross-section. In other words, the decorative molding may be made of extruded aluminum and clipped onto an aluminum or stainless steel frame using the intermediate holding portion which can be made of any suitable material including plastics, for example and without limitation. The intermediate holding portion 2 can be made of a material different from the material of the frame and/or from the material of the decorative molding.

According to an embodiment of the disclosure, the frame 1 is elongated and has a length which allows it to support the boat windshield or a given portion thereof (for example a panel). From an outer wall 12 of the frame 1, there may be inward projections 13, 14 (e.g., an upper inward projection 13 and a lower inward projection 14 which project perpendicularly and inwardly from an inner surface of the outer wall 12). A reinforcement inner wall 15 for reinforcement may be provided on an inner portion of the frame 1 to add rigidity to the lower inward projection 14, for example. The outer wall 12 can comprise inclined portions by the top edge and by the bottom edge thereof.

An inner downward lip 16 is provided and can project downwardly from the upper inward projection 13, for example.

Similarly, an inner upward lip 17 is provided and can project upwardly from the lower inward projection 14, for example.

Together the inner downward lip 16 and the inner upward lip 17 can project from their respective base from their respective inward projection (13, 14) toward each other, but not touching each other thereby leaving a free space (19) in between. This free space or gap 19 is where the intermediate holding portion 2 can be secured by being clipped or inserted in said gap, between the inner downward lip 16 and the inner upward lip 17 which hold the intermediate holding portion 2 in place in between them. The intermediate holding portion 2 may comprise an upper outward member 21 and a lower outward member 22 which are configured to engage with the inner downward lip 16 and the inner upward lip 17, respectively, by being oriented in opposite directions and by having the same spacing in between, which corresponds to the free space or gap 19 between the inner downward lip 16 and the inner upward lip 17.

The insertion may done either by pushing (urging) the intermediate holding portion 2 facing the free space or gap 19 against the lips 16, 17 from the front thereof, and by temporary deformation, clipping the intermediate holding portion 2 into the free space or gap 19, locked by the lips 16, 17, where either the holding portion 2 or the lips (or both) have undergone some deformation to allow this clipping to take place. While the intermediate holding portion 2 is not necessarily made of a resilient material, it may undergo a minor but effective resilient deformation despite the metallic material for the clipping to take place. Otherwise, according to another embodiment of the disclosure, the material of the intermediate holding portion 2 may be a polymer which can be a resilient material to undergo a more significant resilient deformation. Alternatively, whether the intermediate holding portion 2 or the lips are rigid or flexible, the intermediate holding portion 2 may be inserted from the side of the frame 1 to have its outward members 21, 22 engage with the corresponding lips 16, 17 and then slid along the frame 2 (where the lips 16, 17 act as a rail) to position the intermediate holding portion 2 to a given position on the frame 2.

According to an embodiment, the intermediate holding portion 2 may have the same length or approximately the same length as the frame 1 to which it is secured. According to another embodiment, the intermediate holding portion 2 may be much shorter than the frame 1, and therefore a plurality of portions (more than one; at least two) are provided in the same frame 1. Preferably, a spacing may be provided between each of the plurality of intermediate holding portions 2 when each is positioned in the same frame 1, such that the plurality of intermediate holding portions 2 form discontinuous segments that occupy various parts of the length of the frame 1 while saving on materials (cost, weight) since the plurality of intermediate holding portions 2 with spacing in between require less material than a continuous intermediate holding portions 2 as long as the frame 1. Having less weight is useful on a boat.

The decorative molding 3 provided with the desired length, such as the same length as the frame 1, and is finished on its outer wall 31 to have the desired finish to be seen by the users of the boat. On the inner side of the decorative molding, the decorative molding 3 comprises an elongated portion 32 extending along the length of the decorative molding 3 on its inner side and having a section which can be circular, elliptical, triangular or other cross-section shape admitting a complementary shape for holding it. More specifically, the elongated portion 32 can have a rod shape or bar shape offering an upper abutting surface 33 and a lower abutting surface 34 as well shown in FIGS. 2-3, and which are therefore relatively flat and oriented toward the inside (opposite the outer wall 31 which is finished) and respectively upwardly or downwardly (therefore having mirrored inclinations). A remainder of the elongated portion 32 may comprise convex surfaces which define a bulky shape (bulky volume) around which arms of the intermediate holding portion 2 may extend, effectively surrounding at least in part said bulky shape or bulky volume defined by the convex surfaces of the elongated portion 32 on the inner side of the decorative molding 3. Said elongated portion 32 extends from or connects to the decorative molding 3 by having the arms (26, 27) of the intermediate holding portion 2 clip to the elongated portion 32 having this appropriate complementary shape.

The intermediate holding portion 2 may therefore comprise arms, as mentioned above, that is, according to an embodiment of the disclosure: an upper arm 26 and a lower arm 27. These arms 26, 27 extend away from a center of the intermediate holding portion 2, opposite the outward members 21, 22. These arms 26, 27 form a semi-closed shape acting as a grip having an inner shape complementary with the bulky shape or bulky volume defined by the convex surfaces of the elongated portion 32 and also abutting on the upper abutting surface 33 and the lower abutting surface 34 of the elongated portion 32 of the decorative molding 3, as well shown in FIGS. 2-3. Conversely, the elongated portion 32 is shaped complementarily to the inner volume if the grip formed by the pair of arms 26, 27.

Figure 8:
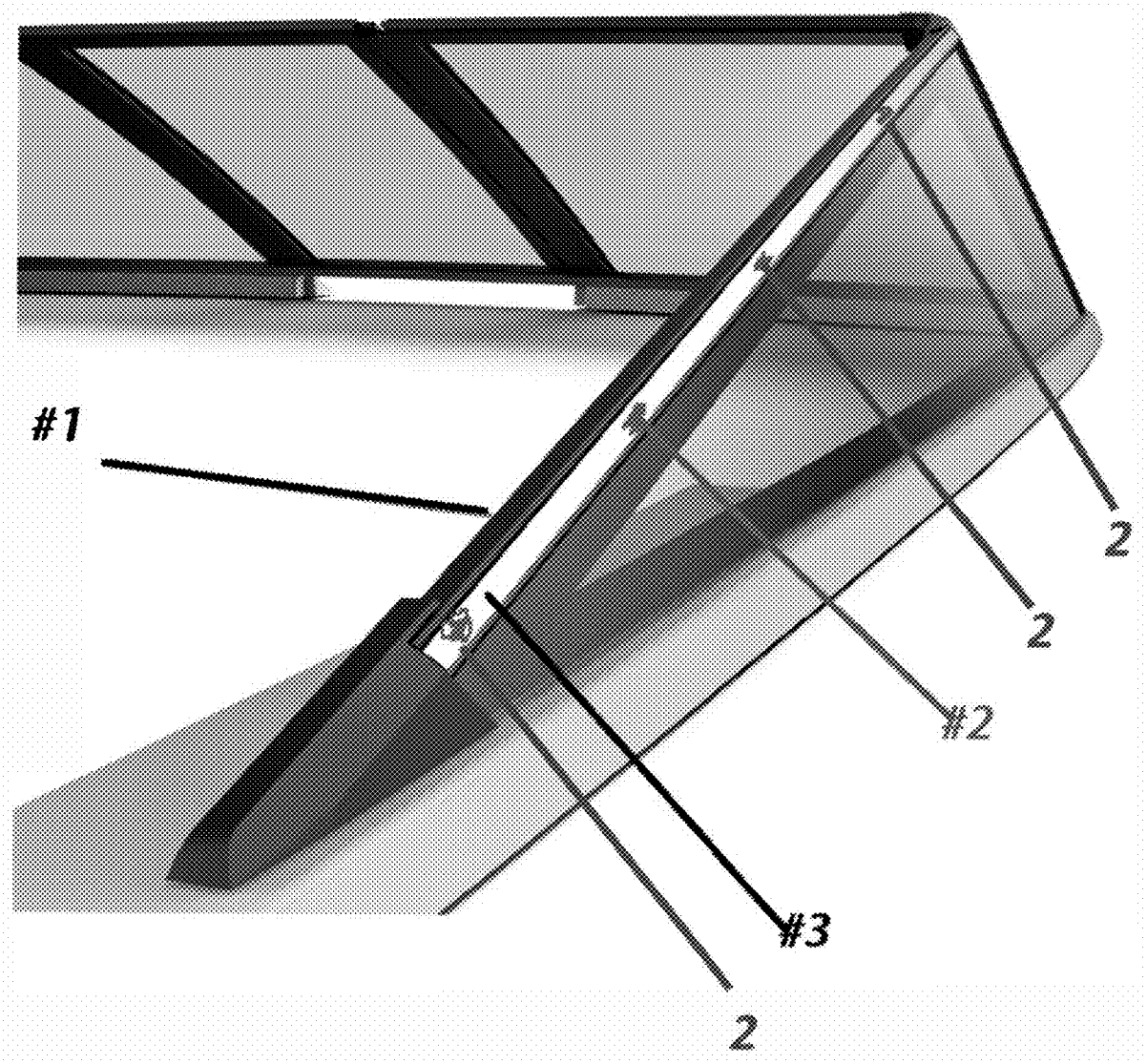
FIG. 8 is a perspective view illustrating an assembled boat windshield frame system with a boat windshield, showing a plurality of interspaced intermediate holding portions, according to an embodiment of the invention; and It will be noted that throughout the appended drawings, like features are identified by like reference numerals.

The elongated portion 32 of the decorative molding 3 can therefore be inserted into the arms 26, 27 of the intermediate holding portion 2 to secure them together. As mentioned above, there can be one, long intermediate holding portion 2 or, as shown in FIG. 8, there can be a plurality of shorter, interspaced intermediate holding portions 2 to which the decorative molding 3 is to be secured for indirect attachment on the frame 1 via the intermediate holding portion 2, provided as a single, unique member, or provided as a plurality of distinct and discontinuous segments.

The insertion may be done either by pushing (urging) the elongated portion 32 of the decorative molding 3 against intermediate holding portion 2 arms 26, 27, and by deformation, clipping the elongated portion 32 into the inner space formed between the arms 26, 27 of the intermediate holding portion 2, where the arms 26, 27 of the intermediate holding portion 2 have undergone some deformation to allow this clipping to take place, with the help of the abutting surfaces 33, 34 forcing said deformation upon insertion by the relative force exerted during insertion of the elongated portion 32 into the inner space formed between the arms 26, 27. Alternatively, whether the intermediate holding portion's arms 26, 27 are rigid or flexible, the elongated portion 32 of the decorative molding 3 may be inserted from the side of the intermediate holding portion 2 to have its elongated portion 32 engage with the corresponding inner space formed between the arms 26, 27 of the intermediate holding portion 2 and then slid along the intermediate holding portion 2 (where the arms 26, 27 of the intermediate holding portion 2 or segments thereof act as a rail for the sliding movement of the elongated portion 32 therein) to position the intermediate holding portion 2 to a given position on the elongated portion 32.

The at least one intermediate holding portion 2 may be connected first to the frame 1, and then the decorative molding 3 is connected to the already installed at least one intermediate holding portion 2. Alternatively, the at least one intermediate holding portion 2 may be connected first to the decorative molding 3, and then the at least one intermediate holding portion 2 with decorative molding 3 connected thereto is clipped onto or slid inside the frame 1. In either case, the result is that the decorative molding 3 is indirectly attached to the frame via at least one intermediate holding portion 2 sandwiched between them and making the connection to both simultaneously, on opposite sides of said at least one intermediate holding portion 2.

According to an embodiment of the disclosure, the frame 1 is made of aluminum and fabricated by extrusion, it is therefore an extruded aluminum part.

According to an embodiment of the disclosure, the decorative molding 3 is made of aluminum, stainless steel or another metal, and fabricated by extrusion, it is therefore an extruded metal part. The finish on the outer wall 31 may include, without limitation: a polished finish, a chromed finish, a brushed finish, a paint, etc., providing the desired aesthetic finish only on the outer wall 31 of the decorative molding 3.

According to an embodiment of the disclosure, the intermediate holding portion 2 is made of plastic, a polymer or any other resilient material, and can be fabricated by either extrusion or molding, such that the intermediate holding portion 2 is an extruded plastic part or a molded plastic part (or an extruded or molded polymer part or resilient material part).

The plastic material or other functionally equivalent material exhibit sufficient flexibility such that the outward members 21, 22 elastically deform (i.e., deform under a force and then take back the original shape) when the intermediate holding portion 2 is frontwardly pushed against the more rigid, metallic lips 16, 17 of the frame 1, thereby clipping the intermediate holding portion 2 onto the frame 1. Preferably, and as mentioned above, at least one intermediate holding portion 2 is clipped onto a single frame 1, i.e., either a long intermediate holding portion 2 having a length similar to the length of the frame or only slightly smaller, or alternatively, clipping a plurality of shorter intermediate holding portions 2 or segments interspaced (having a spacing in between with nothing clipped on the frame in this spacing). Then, the decorative molding 3 can be pushed/urged onto the at least one intermediate holding portion 2 to have its elongated portion 32 push and deform the flexible, plastic-made arms 26, 27 which temporarily open by deformation to receive the elongated portion 32 thereinto and then close around it to hold it in place once inserted by this push-clipping. The decorative molding 3 is thereby clipped to the at least one intermediate holding portion 2 already clipped on the frame 1. Using a flexible plastic for the at least one intermediate holding portion 2 enables this two-step clipping which can be useful during assembly.

Whether the insertion is performed by clipping (taking advantage of the flexible nature of the plastic material forming the at least one intermediate holding portion 2) or by side-insertion/sliding (regardless of the materials being used in their flexibility but shaped to form a captive rail arrangement), the decorative molding 3 can advantageously be removed by applying an opposite movement. Sliding the decorative molding 3 out from the at least one intermediate holding portion 2 is possible, but unclipping may be preferable for easier detachment (requiring a flexible material such as plastic for forming the at least one intermediate holding portion 2). Having a detachable decorative molding 3 is useful because it can be removed if it is damaged without having to remove the frame 1.

When more than one interspaced intermediate holding portions 2 are used, the number thereof, the length and the spacing can be arranged to secure the decorative molding 3 with the contemplated resistance to removal. Having too many segments forming the intermediate holding portions 2 with shorter spacing therebetween can imply that the decorative molding 3 is hard to remove (for replacement or repairs), and too few with large spacing may imply that the decorative molding 3 is held in place but the mounting is fragile. For example, FIGS. 5-6 show the parts being clipped to be assembled together, where the inner space comprising the plurality of intermediate holding portions 2 exhibit a spacing at the visible end. The inner structure comprising a plurality of short, interspaced intermediate holding portions 2 is well shown in FIG. 8.

Using the at least one intermediate holding portion 2 with a flexible material such as plastic to make the connection between the frame 1 and the decorative molding 3 is useful to reduce vibrations between these parts when the boat is in movement, thereby increasing solidity and the useful lifetime of the parts which undergo smaller vibrations.

Also, using the flexible material such as plastic for the at least one intermediate holding portion 2 along with the shape of the elongated portion 32 which includes a bulky convex part ending with an upper and a lower flat walls (the abutting surfaces 33, 34) shows a gradient of curvature of the elongated portion 32 captive inside an inner volume of a complementary shape within the plastic-made arms 26, 27 of the intermediate holding portion 2. This gradient of curvature, starting from the flat abutting surfaces 32, 33 and becoming convex, increases the solidity of the assembly of one part captive inside the other with the complementary shape.

According to an exemplary embodiment, the decorative molding 3 could include a top groove to attach a boat roof system thereto.

According to another aspect of the disclosure, a method for assembling the boat windshield frame system can comprises the following steps, wherein FIGS. 1-3 show the assembly of the boat windshield frame system being performed or having been carried on:

providing a frame having opposed lips forming a gap in between;

engaging at least one intermediate holding portion comprising a pair of outward members to the opposed lips in the gap of the frame for securing the at least one intermediate holding portion to the frame, the at least one intermediate holding portion further comprising a pair of arms forming a grip, wherein the engaging can be made by clipping or by sliding insertion; and securing a decorative molding to the at least one intermediate holding portion, the decorative molding comprising an outer wall and an elongated member opposite the outer wall, the elongated member being shaped complementary to an inside of the grip of the at least one intermediate holding portion, wherein the securing can be made by clipping or by sliding insertion.

While preferred embodiments have been described above and illustrated in the accompanying drawings, it will be evident to those skilled in the art that modifications may be made without departing from this disclosure. Such modifications are considered as possible variants comprised in the scope of the disclosure.

The invention claimed is:

1. A boat windshield frame system comprising:

a frame having opposed lips forming a gap in between;

at least one intermediate holding portion comprising a pair of outward members configured to engage with the opposed lips in the gap of the frame for securing the at least one intermediate holding portion to the frame, the at least one intermediate holding portion further comprising a pair of arms forming a grip; and a decorative molding comprising an outer wall and an elongated member opposite the outer wall for connection to the at least one intermediate holding portion, the elongated member being shaped complementary to an inside of the grip of the at least one intermediate holding portion.

2. The boat windshield frame system of claim 1, wherein the at least one intermediate holding portion is made of a plastic material for clipping the pair of outward members thereof to the opposed lips of the frame.

3. The boat windshield frame system of claim 2, wherein the at least one intermediate holding portion is made of a plastic material and for clipping the elongated member of the decorative molding onto the pair of arms of the at least one intermediate holding portion.

4. The boat windshield frame system of claim 2, wherein the at least one intermediate holding portion comprises a plurality of intermediate holding portions clipped onto the frame in an interspaced manner.

5. The boat windshield frame system of claim 4, wherein the decorative molding is clipped onto the plurality of intermediate holding portions clipped onto the frame in the interspaced manner.

6. The boat windshield frame system of claim 1, wherein the at least one intermediate holding portion has the pair of outward members slidingly inserted within the opposed lips of the frame in a rail arrangement.

7. The boat windshield frame system of claim 6, wherein the at least one intermediate holding portion comprises a plurality of intermediate holding portions slidingly inserted in the frame in an interspaced manner.

8. The boat windshield frame system of claim 7, wherein the decorative molding is clipped onto the plurality of intermediate holding portions clipped onto the frame in the interspaced manner.

9. The boat windshield frame system of claim 1, wherein the elongated member of the decorative molding is slidingly inserted within the pair of arms of the at least one intermediate holding portion in a rail arrangement.

10. The boat windshield frame system of claim 1, wherein the decorative molding is made of aluminum which is extruded to form the decorative molding.

11. The boat windshield frame system of claim 1, wherein the frame is made of stainless steel which is extruded to form the frame.

12. A method for assembling boat windshield frame system comprising:

providing a frame having opposed lips forming a gap in between;

engaging at least one intermediate holding portion comprising a pair of outward members to the opposed lips in the gap of the frame for securing the at least one intermediate holding portion to the frame, the at least one intermediate holding portion further comprising a pair of arms forming a grip; and securing a decorative molding to the at least one intermediate holding portion, the decorative molding comprising an outer wall and an elongated member opposite the outer wall, the elongated member being shaped complementary to an inside of the grip of the at least one intermediate holding portion.

13. The method of claim 12, wherein engaging the at least one intermediate holding portion to the opposed lips of the frame comprises clipping the pair of outward members thereof to the opposed lips of the frame.

14. The method of claim 12, wherein securing the decorative molding to the at least one intermediate holding portion comprises clipping the elongated member of the decorative molding onto the pair of arms of the at least one intermediate holding portion.

15. The method of claim 14, wherein the decorative molding is clipped onto the plurality of intermediate holding portions clipped onto the frame in the interspaced manner.

16. The method of claim 12, wherein engaging the at least one intermediate holding portion to the opposed lips of the frame comprises slidingly inserting the pair of outward members within the opposed lips of the frame in a rail arrangement.

17. The method of claim 16, wherein the at least one intermediate holding portion comprises a plurality of intermediate holding portions, wherein engaging the plurality of intermediate holding portions to the opposed lips of the frame comprises slidingly inserting the plurality of intermediate holding portions in the frame in an interspaced manner.

18. The method of claim 17, wherein connecting the decorative molding to the at least one intermediate holding portion comprises clipping the decorative molding onto the plurality of intermediate holding portions clipped onto the frame in the interspaced manner.

19. The method of claim 12, wherein securing the decorative molding to the at least one intermediate holding portion comprises slidingly inserting the decorative molding within the pair of arms of the at least one intermediate holding portion in a rail arrangement.

20. An intermediate holding portion for a boat windshield frame system comprising a frame having opposed lips forming a gap in between and a decorative molding, the intermediate holding portion comprising a pair of outward members configured to engage with the opposed lips in the gap of the frame for securing the at least one intermediate holding portion to the frame by clipping or by sliding, the at least one intermediate holding portion further comprising a pair of arms forming a grip to secure the decorative molding thereto by clipping or by sliding, the intermediate holding portion being of a material which is different from a material of the frame and different from a material of the decorative molding.

* * * * *